US007285240B2

(12) United States Patent
Scheer et al.

(10) Patent No.: US 7,285,240 B2
(45) **Date of Patent: *Oct. 23, 2007**

(54) METHOD OF FORMING THREE-DIMENSIONAL WOVEN TEXTILE FABRICS WITH CONTRASTING AESTHETIC PRESENTATION

(75) Inventors: Dennis Clark Scheer, Greensboro, NC (US); Cynthia Dawson McNaull, Wilmington, NC (US)

(73) Assignee: Polymer Group, Inc., Charlotte, NC (US)

( * ) Notice: Subject to any disclaimer, the term of this patent is extended or adjusted under 35 U.S.C. 154(b) by 402 days.

This patent is subject to a terminal disclaimer.

(21) Appl. No.: 10/261,041

(22) Filed: Sep. 30, 2002

(65) Prior Publication Data

US 2003/0082303 A1 May 1, 2003

Related U.S. Application Data

(60) Provisional application No. 60/326,435, filed on Oct. 1, 2001.

(51) Int. Cl.
*B05D 5/00* (2006.01)

(52) U.S. Cl. ..... 264/570; 264/284; 28/104; 442/408

(58) Field of Classification Search ..... 264/570, 264/284; 28/104; 442/408
See application file for complete search history.

(56) References Cited

U.S. PATENT DOCUMENTS 3,485,706 A 12/1969 Evans
4,497,095 A * 2/1985 Minemura et al. ..... 26/2 R
4,967,456 A 11/1990 Sternlieb et al.
4,995,151 A * 2/1991 Siegel et al. ..... 26/69 R
5,098,764 A 3/1992 Drelich et al.
5,244,711 A 9/1993 Drelich et al.
5,632,072 A 5/1997 Simon et al.
5,822,823 A 10/1998 Polzin et al.
5,827,597 A 10/1998 James et al.
6,564,436 B2 * 5/2003 Black et al. ..... 28/104
6,606,771 B2 * 8/2003 Curtis et al. ..... 28/167

FOREIGN PATENT DOCUMENTS

WO WO 01/59194 A1 8/2001

* cited by examiner

*Primary Examiner*—Suzanne E. McDowell
(74) *Attorney, Agent, or Firm*—Kilyk & Bowersox, PLLC; Valerie Calloway

(57) ABSTRACT

A method imaging a woven textile fabric comprises the steps of providing a woven textile fabric having a plurality of interwoven warp and weft yarns comprising aesthetically contrasting fibrous components. A three-dimensional image transfer device is provided with the woven textile fabric positioned thereon, and subjected to hydraulic imaging by application of pressurized liquid streams. The liquid streams are applied to a surface of the fabric facing away from the image transfer device, to thereby impart the pattern of the image-forming surface of the three-dimensional transfer device to the fabric. The resultant fabric can find application as an apparel article, a home fashion article, or an upholstery backing.

4 Claims, 12 Drawing Sheets

METHOD OF FORMING THREE-DIMENSIONAL WOVEN TEXTILE FABRICS WITH CONTRASTING AESTHETIC PRESENTATION

CROSS-REFERENCE TO RELATED APPLICATION

The present application claims the benefit of priority provisional patent application Ser. No. 60/326,435, filed Oct. 1, 2001.

TECHNICAL FIELD

The present invention relates generally to a method of creating a three-dimensional woven textile fabric, and more particularly to a method of applying hydraulic energy in conjunction with a three-dimensional image transfer device, whereby a specific and desirable pattern defined by the image transfer device is durably imparted into the pre-colored fibrous component of the woven fabric.

BACKGROUND OF THE INVENTION

Woven textile fabrics, of which include a plurality of interwoven warp and weft yarns, are used for all manner of applications, including apparel, home furnishings, recreational products, and industrial applications. Because of the expense associated with spinning of yarns, and weaving of textile fabrics, techniques have been developed for manufacture of nonwoven fabrics from fibrous or filamentary materials. Typically, manufacture of nonwoven fabrics entails creating a web or batt of fibrous or filamentary material, and treating the web in a manner to provide the resultant fabric with the desired physical properties.

One manner of making nonwoven fabrics, which has met with widespread commercial success, involves hydraulically treating the fabric with high-pressure liquid (water) streams, which act to entangle and integrate the fibrous material. Such hydroentangling techniques are disclosed in U.S. Pat. No. 3,485,706, to Evans, hereby incorporated by reference.

More recently, hydroentangling techniques have been developed for manufacture of nonwoven fabrics whereby patterning and imaging of the fabric can be affected as the fabric is hydraulically formed on a three-dimensional image transfer device. U.S. Pat. Nos. 5,098,764, 5,244,711, 5,822,823, and 5,827,597, the disclosures of which are hereby expressly incorporated by reference, relate to the use of such three-dimensional image transfer devices. Use of these types of devices permits greatly enhanced versatility in the production of hydroentangled nonwoven fabrics.

Recognizing the efficient means by which three-dimensional patterns can be achieved through manufacture of nonwoven fabrics by hydroentanglement, efforts have been made to treat woven textile fabrics hydraulically in order to form images and patterns therein.

U.S. Pat. Nos. 4,967,456 and 4,995,151, hereby incorporated by reference, disclose techniques for hydro-enhancing and hydro-patterning fabric. Practice of the hydro-enhancing and hydro-patterning techniques requires the use of a mesh screen. The mesh screen is embossed with the desired three-dimensional pattern, which is then used as the foraminous surface against which woven fabrics are treated with hydraulic energy. The use of mesh screens, however, has an inherent and deleterious flaw which precludes the acceptable treatment on continuous yardages of woven material. In order to form a mesh screen to be used to treat continuous yardage of material, the screen must be linked at its terminal edges, thus forming a loop or belt. Where the terminal ends of the mesh screen meet to for the loop, there are a plurality of wire ends that must be adjoined. A seam is formed across the length of the formed loop, a seam that becomes part of the overall three-dimensional pattern and creates a repeating defect in the course of treatment of continuous yardage.

The present invention contemplates a method of applying hydraulic energy in conjunction with a three-dimensional image transfer device, whereby a specific and desirable pattern defined by the image transfer device is durably imparted to the woven fabric. The use of a three-dimensional image transfer device is necessary to facilitate the efficient and commercially viable use of the method.

It has been found that the use of an image transfer device allows for the controlled expression of the fibrous content of the warp and weft yarns (referred to as "blooming") comprising a woven textile fabric. When these warp and weft yarns comprise variations in coloration, hue, luster, or intensity, unique aesthetic results are obtained. Such aesthetic results are most visually striking when the image transfer device used has a pronounced variation in the three-dimensional foraminous surfaces.

SUMMARY OF THE INVENTION

The present method of imaging a woven textile fabric having a plurality of interwoven warp and weft yarns, preferably comprising contrasting fibers, contemplates that a three-dimensional image transfer device be provided. The image transfer device has a foraminous, image-forming surface comprising a regular or irregular pattern of three-dimensional surface elements.

The woven textile fabric is positioned on the image transfer device, and hydraulic imaging of the fabric effected by subjecting the fabric to pressurized liquid streams applied to a surface of the fabric facing away from the image transfer device. By the action of the high-pressure liquid stream, the regular pattern defined by the image-forming surface of the image transfer device is imparted to the woven fabric. The pattern imparted to the fabric may include both an image which results from rearrangement and displacement of the fabric yarns, which can impart a three-dimensionality to the fabric, as well as patterning which results from differential blooming of the fabric yarns which corresponds to the pattern of the image transfer device.

The present method has been practiced for imparting an image to woven fabrics comprising aesthetically contrasting fibrous components. As will be appreciated, the technique can be employed for imparting an image to a wide variety of textile fabrics. Standard, low cost textile products can be transformed into high value, three-dimensional fabrics suitable for many apparel, home furnishing, upholstery, and other applications. A fabric which is otherwise substantially uniform in appearance can be provided with an aesthetically pleasing pattern, reflecting the three-dimensionality of the fabric and/or color variations therein.

DETAILED DESCRIPTION

While the present invention is susceptible of embodiment in various forms, there is shown in the figures, and will hereinafter be described a presently preferred embodiment of the invention, with the understanding that the present disclosure is to be considered as an exemplification of the invention, and is not intended to limit the invention to the specific embodiment illustrated.

The present invention contemplates patterning and imaging of woven textile fabrics, comprising a plurality of interwoven warp and weft yarns comprising aesthetically contrasting fibrous components. Positioning of such a woven fabric on the image-forming surface of a three-dimensional image transfer device in conjunction with hydraulic treatment of the fabric desirably acts to efficiently impart an image defined by the image transfer device to the fabric. Under the influence of high-pressure liquid (water) streams, hydraulic treatment of the woven fabric results in displacement of the interwoven yarns so that the fabric is patterned in a fashion corresponding to the pattern defined by the image transfer device. Additionally, imaging of the fabric can be effected as a result of the controlled blooming of the fibrous component of the yarns under the influence of the high-pressure liquid streams, thus enhancing the three-dimensional imaging which can be created and providing a pattern of color differentiation which can, in itself, be desirable.

The woven three-dimensional fabrics of the present invention are suitable for various applications, including, but not limited to apparel, home furnishing, and upholstery. Suitable apparel applications include bottom weights, such as pants or shorts. Home furnishing applications wherein the three-dimensionally imaged woven fabric can be utilized include draperies, slip-covers, and wall coverings. Furthermore, the fabric may be used in upholstery applications, such as backing fabric.

Figure 1:
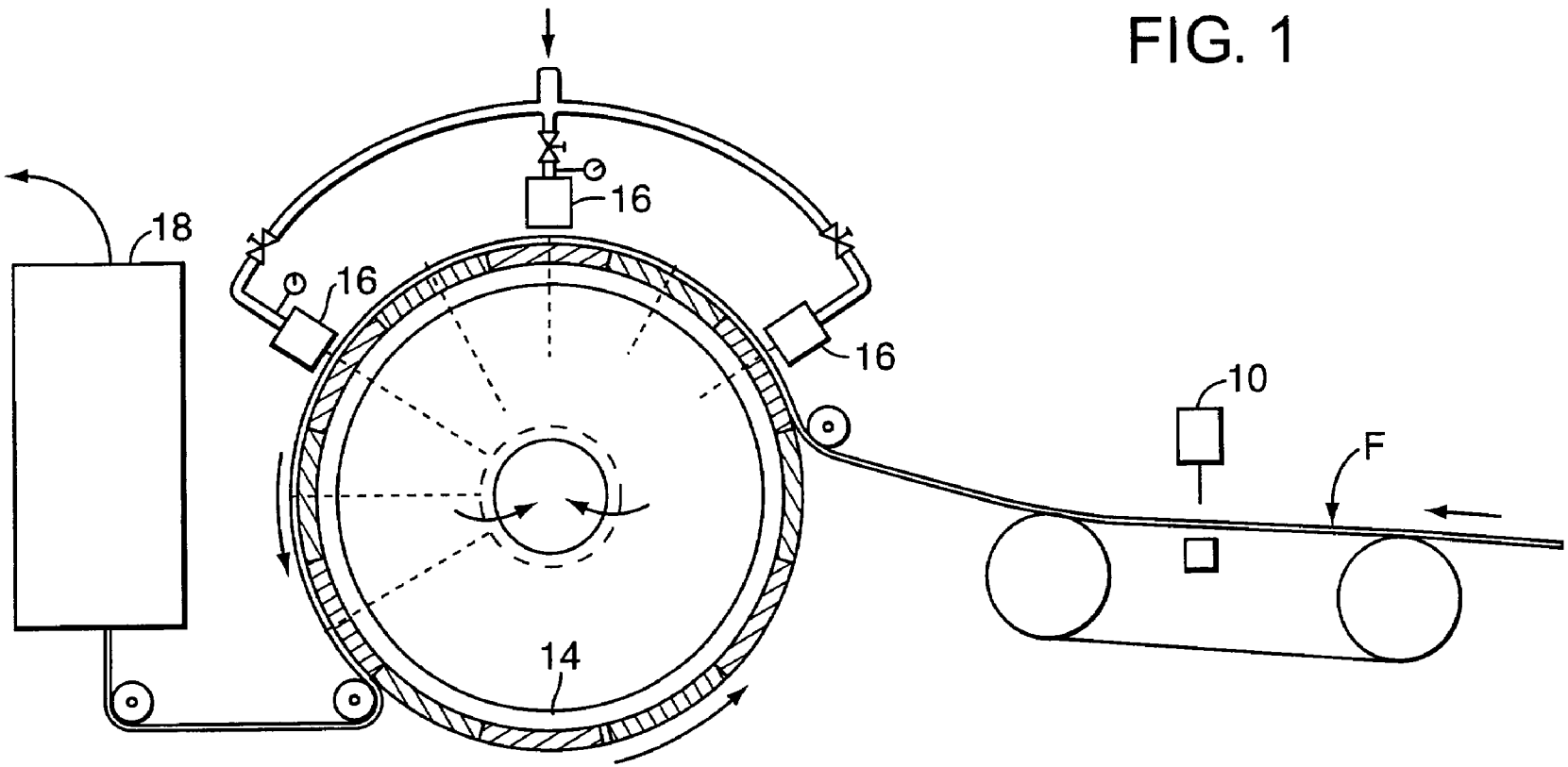
FIG. 1 is a diagrammatic view of an apparatus for imaging a woven textile fabric embodying the principles of the present invention.

FIG. 1 illustrates an apparatus for hydraulically treating woven textile fabrics in accordance with the present invention. The apparatus includes a pre-wetting station 10 at which a precursor woven textile fabric F is positioned for pre-wetting. A pre-wetting manifold may be operated at a pressure on the order of 100 psi to thereby effect pre-wetting of the woven textile fabric F.

The apparatus illustrated in FIG. 1 further includes an imaging an patterning drum 14 comprising a three-dimensional image transfer device for effecting imaging and patterning of the woven textile fabric. The image transfer device includes a movable imaging surface defining a regular or irregular pattern which moves relative to a plurality of entangling manifolds 16 which act in cooperation with three-dimensional elements defined by the imaging surface of the image transfer device to effect imaging and patterning of the woven textile fabric.

The woven textile fabric is advanced onto the image transfer device so that the fabric is positioned on the image-forming surface of the device. The fabric is moved together with the imaging surface relative to the manifolds 16 so that high-pressure liquid streams are directed against the surface of the fabric which faces away from the image-forming surface of the image transfer device.

In current practice of the present invention, three manifolds 16 have been employed, each comprising a single row of orifices each having a diameter of 0.005 inches, with orifices spaced at 50 per inch. Line speeds on the order of 45 feet per minute have been employed, though commercial line speed can be increased significantly, with one stack of drying cans 18 provided operating at approximately 350° F. The manifolds can be operated across a broad range of pressures, 1000 to 4700 psi, with current examples of woven textile fabrics being hydraulically preferably treated with pressures ranging from 2800 to 4700 psi, and most preferably with pressures on the order of 4000 psi.

Figure 2:
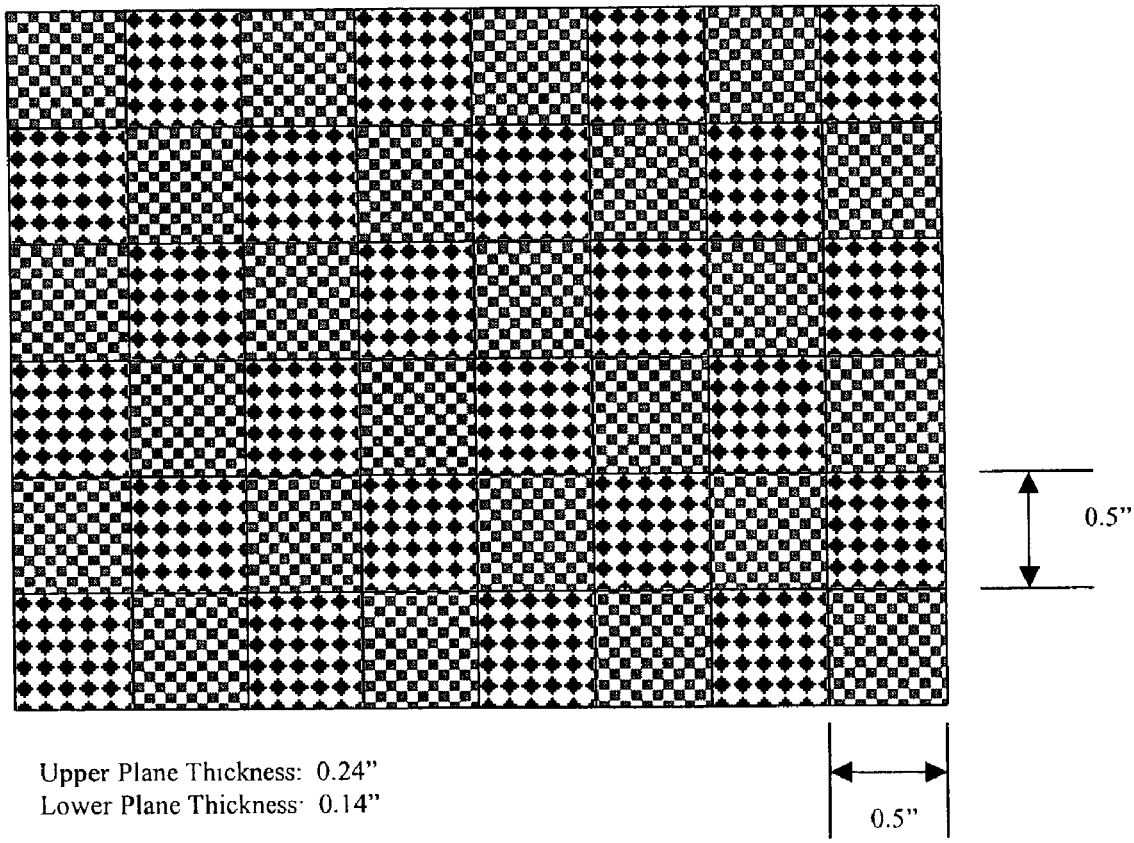
FIG. 2 is a diagrammatic view of the image-forming surface of a three-dimensional image transfer device of the apparatus shown in FIG. 1, referred to as "small squares"
Figure 3:
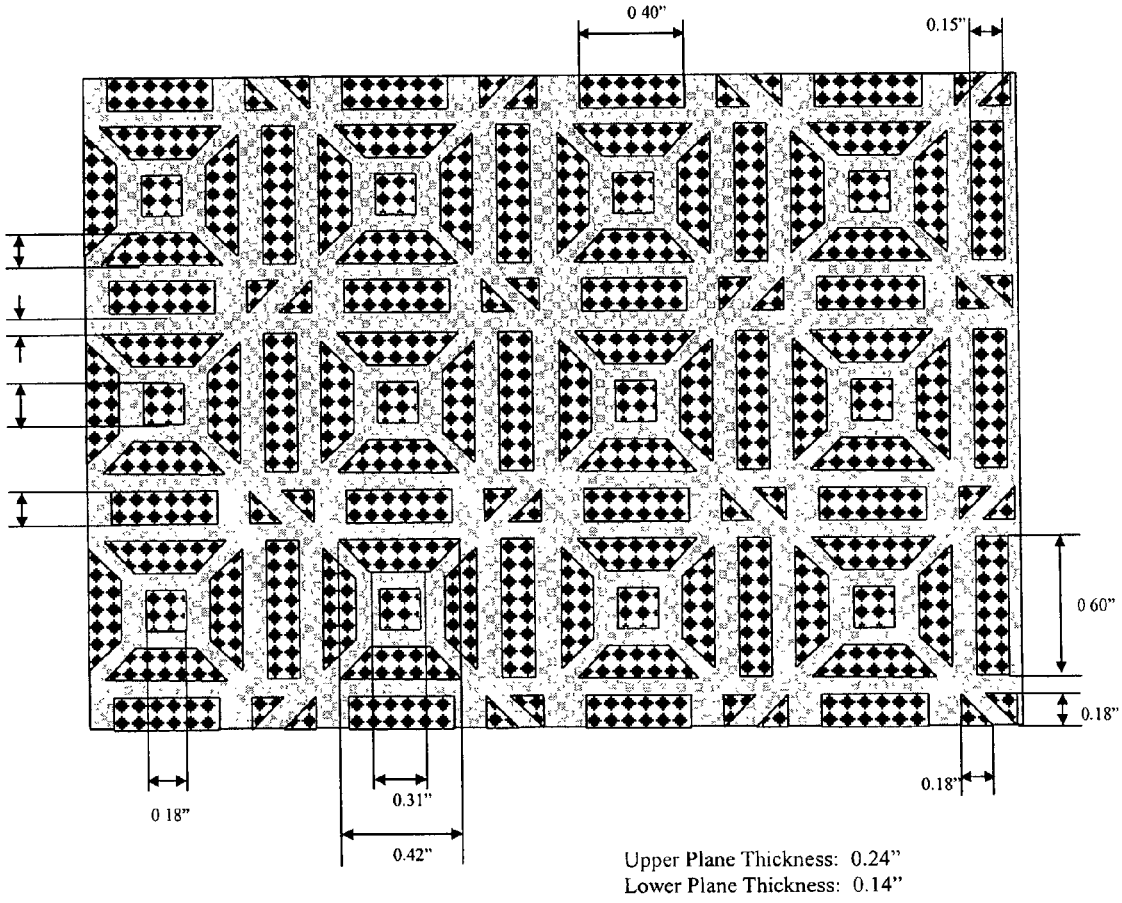
FIG. 3 is a diagrammatic view of the image-forming surface of a three-dimensional image transfer device of the apparatus shown in FIG. 1, referred to as "small diamonds"

FIG. 2 illustrates the image-forming surface of an image transfer device having a "small squares" image pattern. FIG. 3 illustrates a so-called "small diamonds" pattern of the forming surface of the image transfer device.

Figure 4:
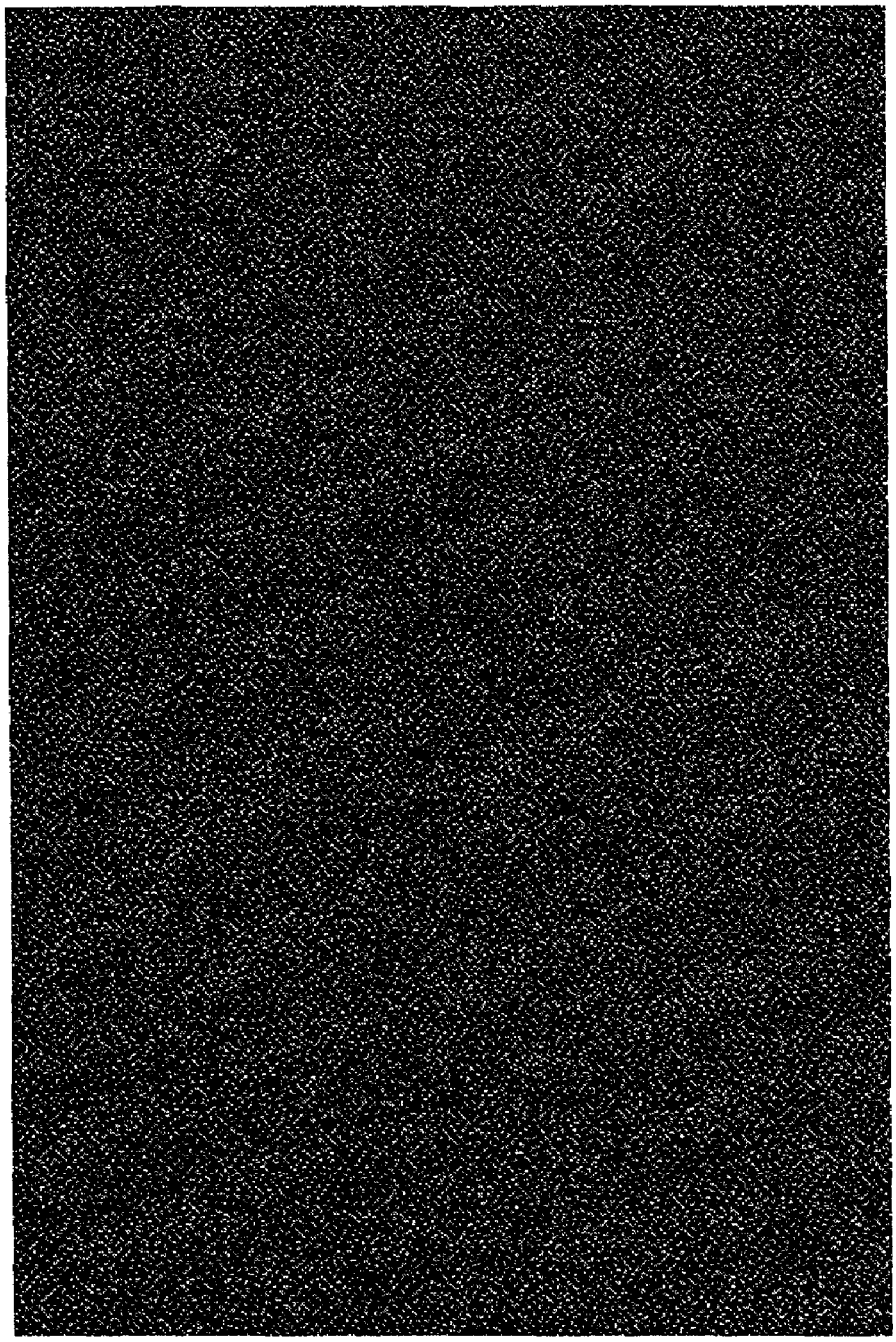
FIG. 4 is a photograph of a woven material prior to imaging on a three-dimensional image transfer device taken with a top-light.
Figure 5:
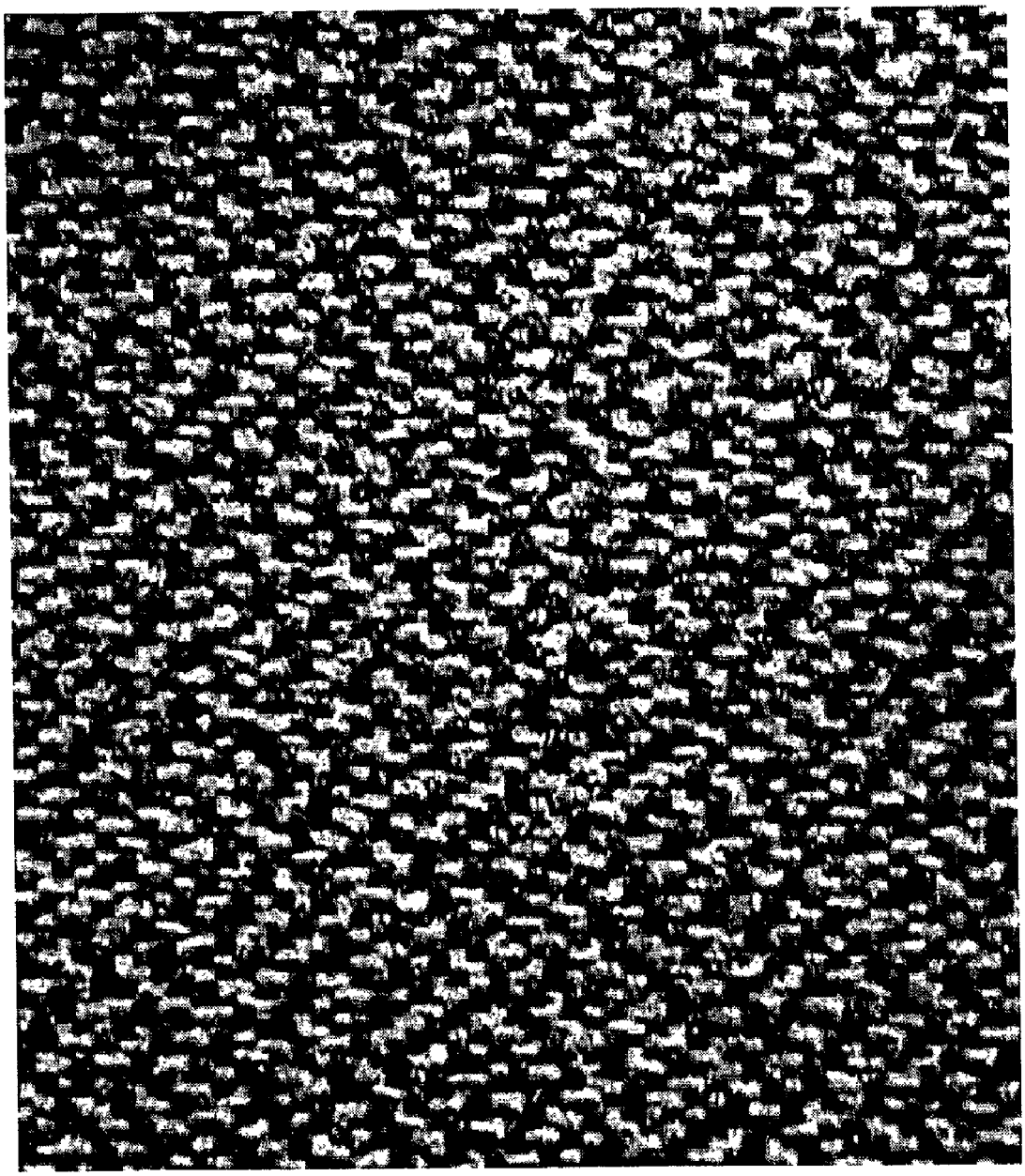
FIG. 5 is a microphotograph of the woven material as in FIG. 4 at a magnification level of approximately 12× taken with a top-light.
Figure 6:
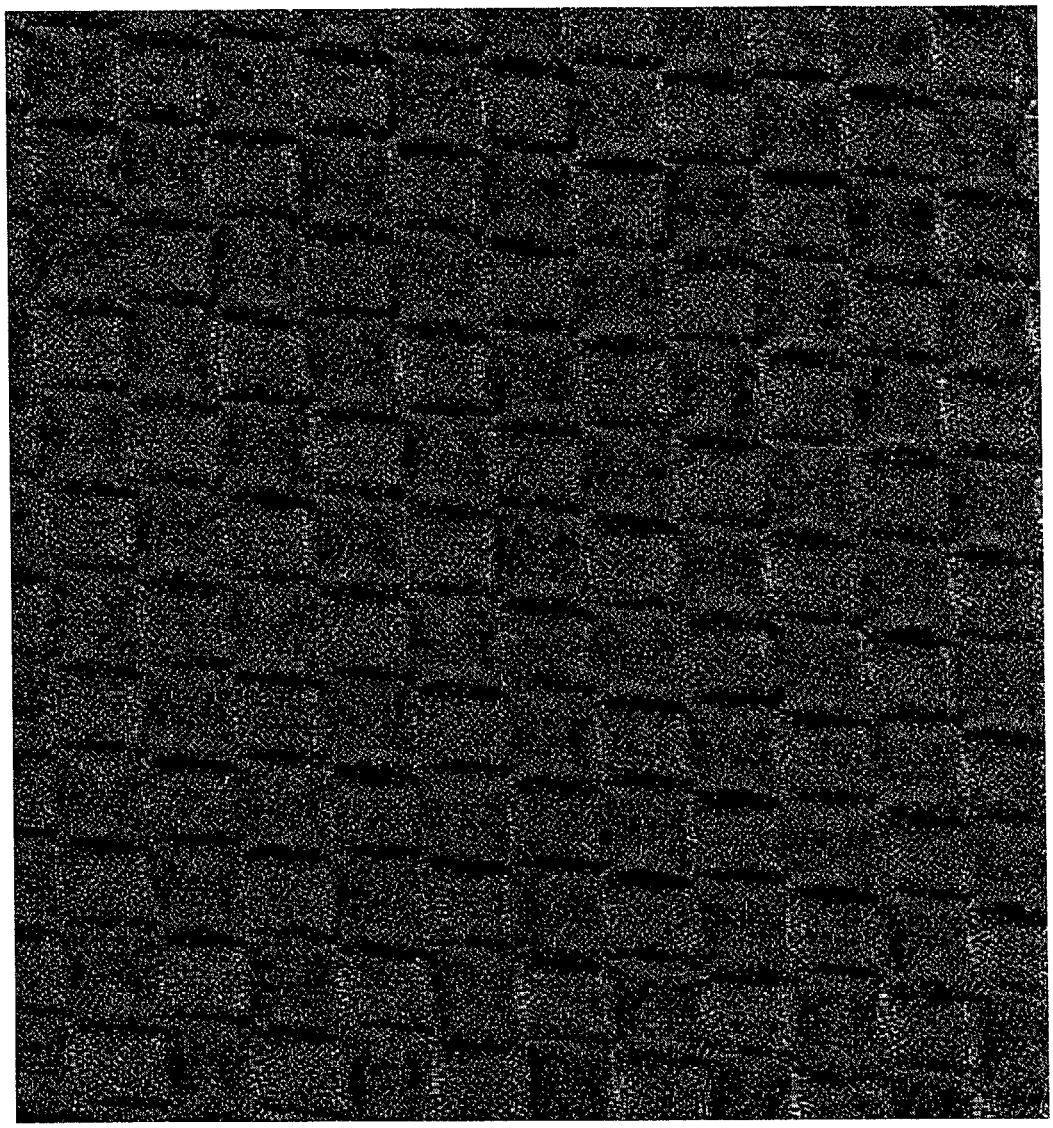
FIG. 6 is a photograph of a woven material after imaging on a three-dimensional image transfer device depicted in FIG. 2 taken with a top-light.
Figure 7:
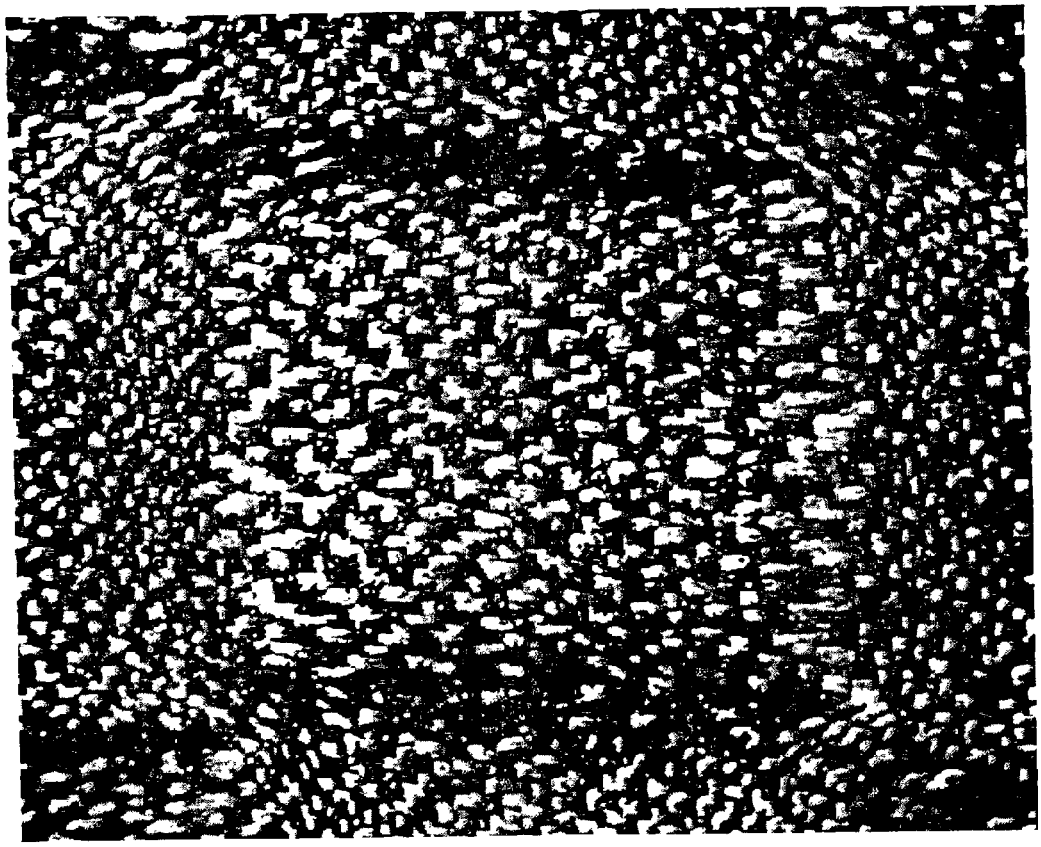
FIG. 7 is a microphotograph of the woven material as in FIG. 6 at a magnification level of approximately 12× taken with a top-light.
Figure 8:
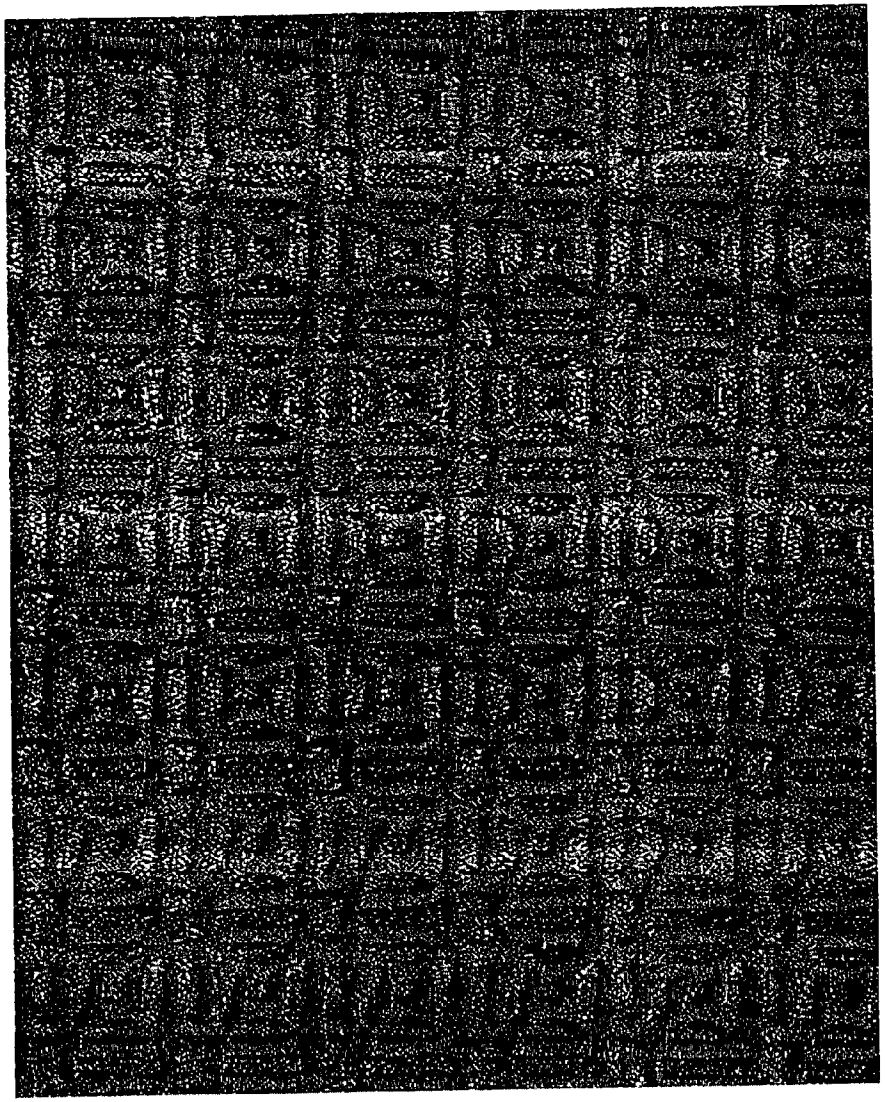
FIG. 8 is a photograph of a woven material prior to imaging on a three-dimensional image transfer device depicted in FIG. 3 taken with a top-light.
Figure 9:
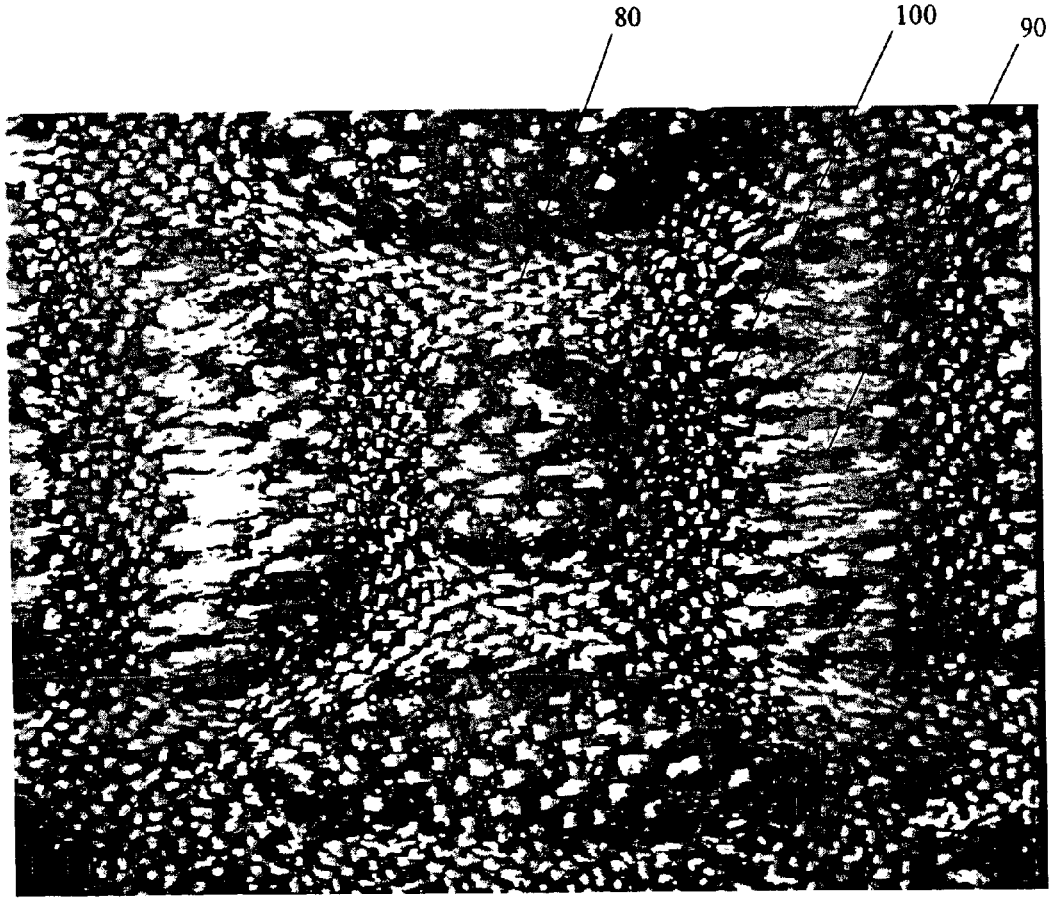
FIG. 9 is a microphotograph of the woven material as in FIG. 8 at a magnification level of approximately 12× taken with a top-light.
Figure 10:
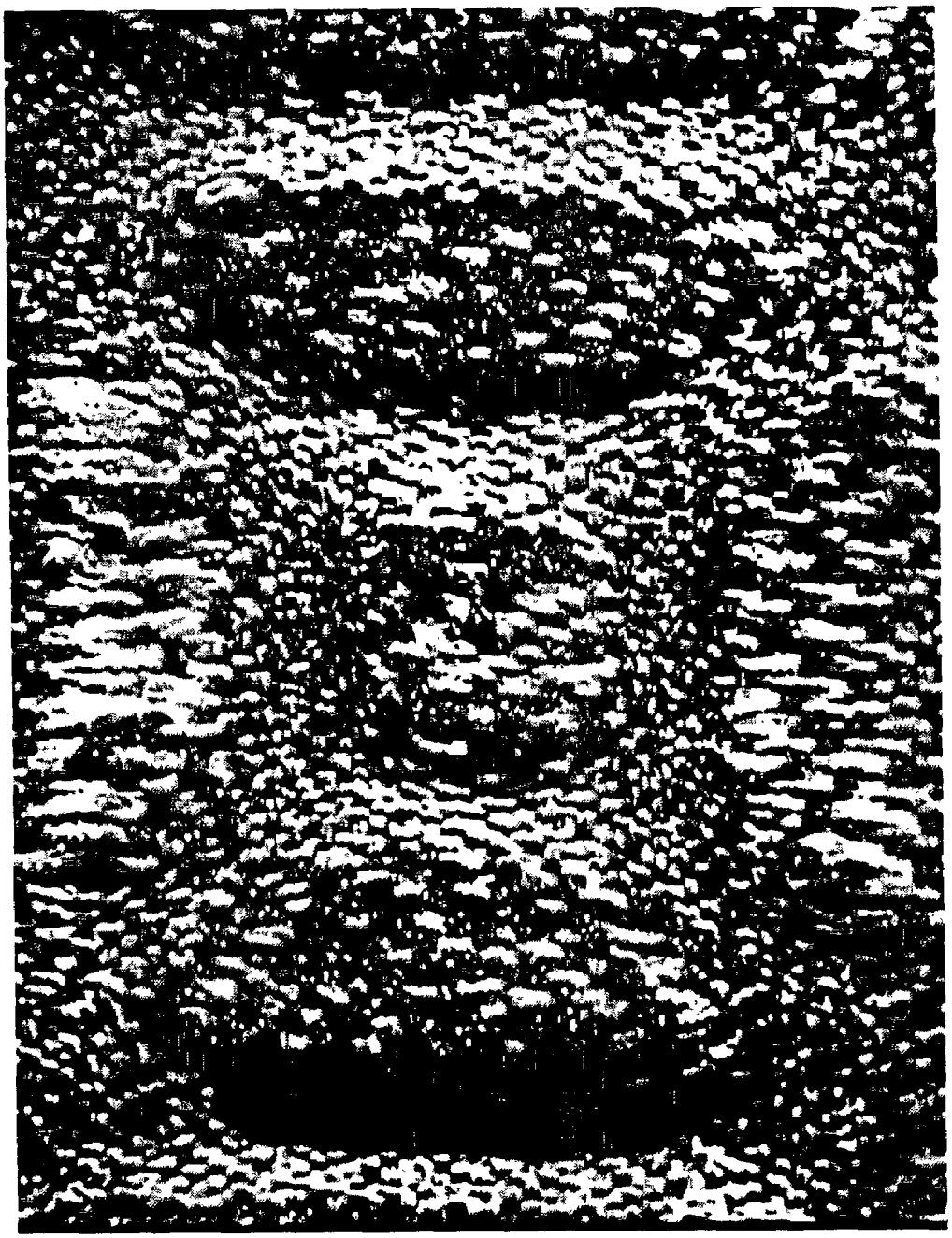
FIG. 10 is a microphotograph of the reverse side of the woven material as in FIG. 8 at a magnification level of approximately 12× taken with a top-light.
Figure 11:
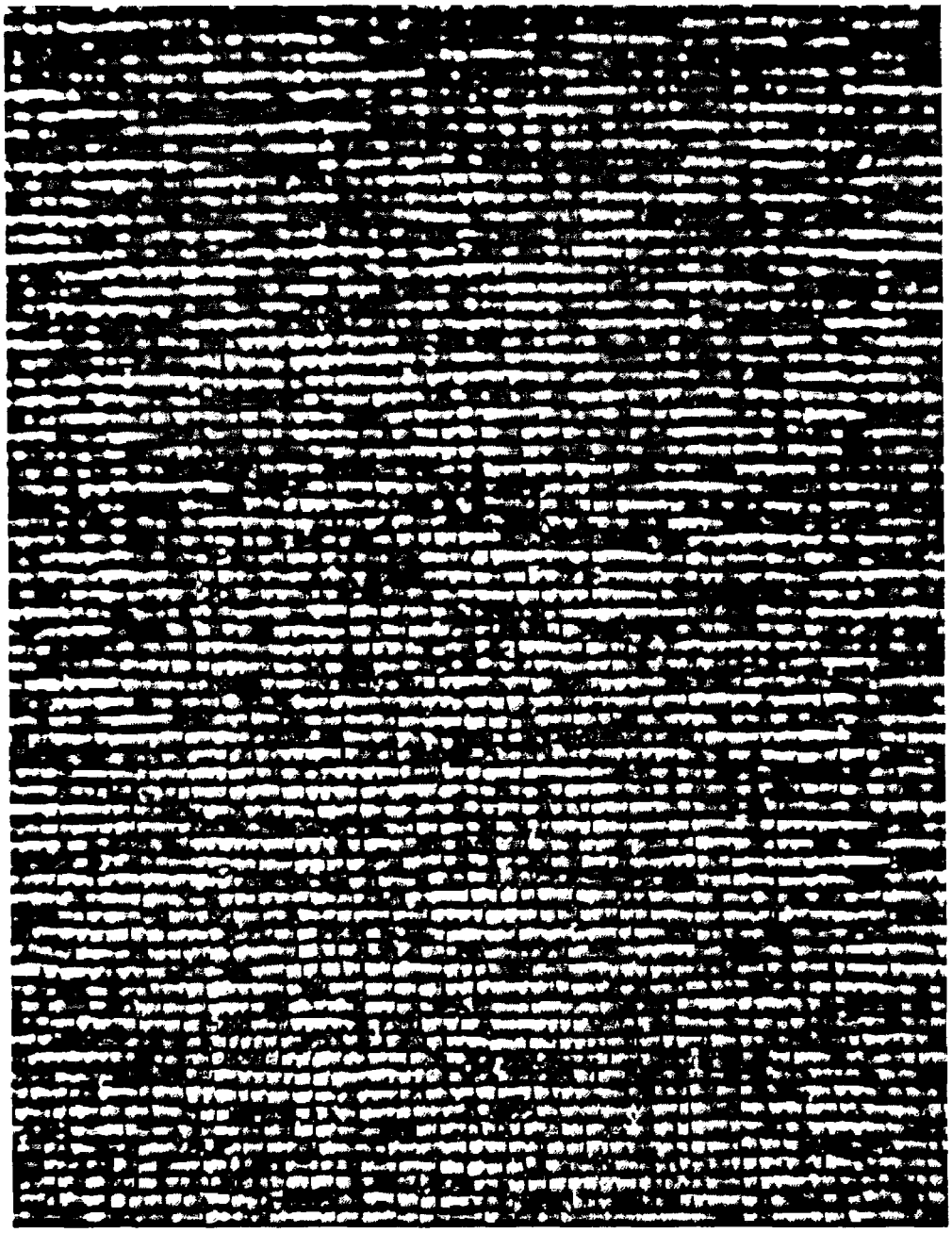
FIG. 11 is a microphotograph of the woven material as in FIG. 4 at a magnification level of approximately 12× taken with a back-light.
Figure 12:
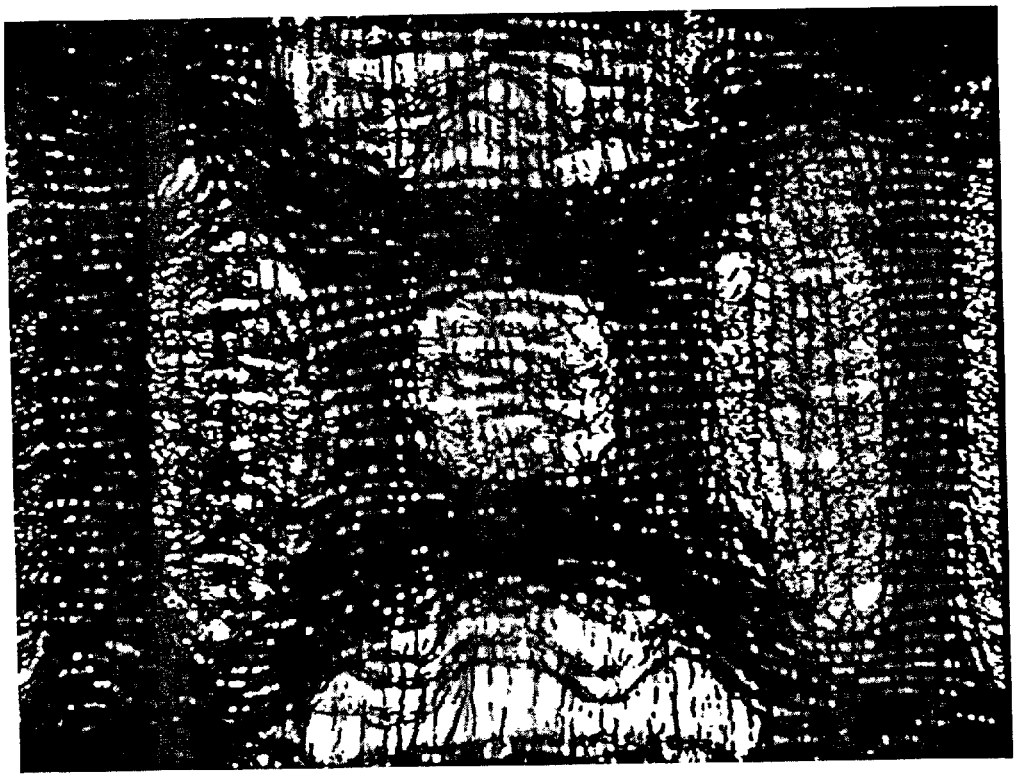
FIG. 12 is a microphotograph of the woven material as in FIG. 8 at a magnification level of approximately 12× taken with a back-light.

Fabrics formed in accordance with the present method exhibited aesthetic properties as set forth in FIGS. 4 through 10. FIGS. 4 and 5 depict a representative starting substrate comprising a 100% polyester woven fabric of contrasting dark colored warp yarns and light colored weft yarns in a stagger fill pattern. FIGS. 6 and 7 depict the starting woven substrate after processing in accordance with the present invention utilizing a "small squares" image transfer device. FIGS. 8 and 9 depict the starting woven substrate after processing in accordance with the present invention utilizing a "small diamonds" image transfer device.

With reference to FIG. 9, two simultaneous effects of employing an image transfer device are particularly noted. Lighter colored weft yarns can be seen to have regions of both high compaction 80, and high distention 90. Further, the difference in blooming of the fibrous content of the weft yarns can be seen to be greater in the high distention region 90 as compared to the weft yarns found in the regions of high warp compaction 100.

It is believed that the controlled redistribution and blooming of the composite yarns is uniquely bound to the foraminous surface of the image transfer device. The foraminous surface of the image transfer device comprises a compound structure of asperities and voids in multiple planes. As the hydraulic energy impacts upon the fabric juxtaposed upon the foraminous surface, deflection of the energy from the surface asperities, compounded by the vectoring of the force due to drainage patterns, allows the image transfer device to create variably compacted regions. Further, the surface asperities can act to constrain blooming of the same yarns such that variable presentation of the fibrous yarn components are expressed.

From the foregoing, numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A method of imaging a woven textile fabric, comprising the steps of:

providing a woven textile fabric having a plurality of interwoven warp and weft yarns comprising aesthetically contrasting fibrous components;

providing a three-dimensional image transfer device having a foraminous image-forming surface comprising a pattern of three-dimensional surface elements;

positioning said woven textile fabric on said image transfer device, and hydraulically imaging said textile fabric by subjecting said fabric to pressurized liquid streams applied to a surface of said fabric facing away from said image transfer device to thereby impart said regular pattern of said image-forming surface to said fabric.

2. A method of imaging a woven textile fabric as in claim 1, wherein the fabric is an apparel article.

3. A method of imaging a woven textile fabric as in claim 1, wherein the fabric is a home fashion article.

4. A method of imaging a woven textile fabric as in claim 1, wherein the fabric is an upholstery backing.

* * * * *